US006612876B2

(12) United States Patent
Hyland

(10) Patent No.: US 6,612,876 B2
(45) Date of Patent: Sep. 2, 2003

(54) RJ MODULAR CONNECTOR HAVING GROUNDING MECHANISM

(75) Inventor: James Hyland, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 77 days.

(21) Appl. No.: 10/005,962

(22) Filed: Nov. 7, 2001

(65) Prior Publication Data

US 2002/0177365 A1 Nov. 28, 2002

Related U.S. Application Data

(63) Continuation-in-part of application No. 09/863,942, filed on May 22, 2001, now Pat. No. 6,413,121.

(51) Int. Cl.[7] ..... H01R 24/00

(52) U.S. Cl. ..... 439/676; 439/83; 439/620; 439/941; 439/607

(58) Field of Search ..... 439/676, 941, 439/607, 83, 620

(56) References Cited

U.S. PATENT DOCUMENTS

| | | | | |
|---|---|---|---|---|
| 6,102,741 A | * | 8/2000 | Boutros et al. | 439/620 |
| 6,276,943 B1 | * | 8/2001 | Boutros et al. | 439/76.1 |
| 6,283,795 B1 | * | 9/2001 | Chen | 439/676 |
| 6,290,546 B1 | * | 9/2001 | Pharney | 439/676 |

* cited by examiner

*Primary Examiner*—P. Austin Bradley
*Assistant Examiner*—Truc Nguyen
(74) *Attorney, Agent, or Firm*—Wei Te Chung

(57) ABSTRACT

A RJ modular connector (1) comprises a housing (10) defining a plug receiving section (11) and a terminal insert receiving section (12). A terminal insert (20) includes a plurality of terminals (21, 22, 23, 24, 25, 26, 27, 28) and a pair of grounding terminals (30) beside the plurality of terminals. An electrical connection is established between the grounding terminals and grounding traces (351, 371, 381, 391, 451, 471, 481, 491) defined between selected pairs of signal terminals through a grounding layer **(31*b*, 41*a*) and a pair of ground pads (329, 429)** defined on a printed circuit board.

1 Claim, 10 Drawing Sheets

RJ MODULAR CONNECTOR HAVING GROUNDING MECHANISM

CROSS REFERENCE TO RELATED APPLICATIONS

This application is a continuation-in-part of commonly assigned U.S. patent application Ser. No. 09/863,942, filed May 22, 2001 is now U.S. Pat. No. 6,413,121.

BACKGROUND OF THE INVENTION

1. Field of the Invention

The present invention relates to a RJ modular connector, and more particularly to a RJ modular connector having a substrate provided therein to balance electrical couplings between terminals and having at least one grounding terminal to eliminate noises.

2. Description of the Prior Art

A RJ modular connector has been widely used in telecommunication system since it was firstly created. A so-called RJ45 modular connector has been widely used in the network system.

The RJ45 modular connector includes totally eight terminals. Resulted from miniaturization of the computer, all corresponding components, including connectors, have to be reduced for their dimension and size. One of the negative consequences or problems resulted from miniaturization is electrical couplings between terminals. Unless the electrical coupling can be effectively controlled within an accepted level, it is unlikely that the RJ45 modular connector can be used in the high-speed signal transmission.

As mentioned above, there are totally eight terminals within the RJ45 connector. There are two different approaches for configuring terminal pair. In the first approach, terminals 1, 2 configure the 3rd pair, terminals 3, 6 configure the 2nd pair, terminals 4, 5 configure the 1st pair, and terminals 7, 8 configure the 4th pair. In the second approach, terminals 1, 2 configure the 2nd pair, terminals 3, 6 configure the 3rd pair, terminals 4, 5 configure the 1st pair, and terminals 7, 8 configure the 4th pair.

The benefit for selecting two terminals as a differential pair, carrying the same signal but with different phases, is if both terminals are affected by the same amount of noise, these noises can be subtracted when both signals arrive at their destination.

Since those eight terminals are equally spaced, electrical coupling between terminals will surely create some problems, i.e. coupling or cross-talk. For example, if we take terminal 3 into consideration, terminal 3 will naturally be imposed with energy from terminals 2 and 4 which are closer to terminal 3. On the other hand, terminal 6, which carries signal having an inverted phase of the signal carried by terminal 3, will also be imposed with energy from terminals 5 and 7. The energy imposed to terminals 3, 6 from respective terminals 4, 5 can be ultimately eliminated because terminals 4, 5 carry the same, but inverted signals. However, energy imposed to terminals 3, 6 from respective terminals 2 and 7 can not be suitably eliminated because terminals 3, 6 is unlikely to establish couplings between terminals 1, 3 and terminals 6, 8 to balance the couplings between terminals 2, 3 and 6, 7. Accordingly, signals transmitted by terminals 3, 6 carry noises resulted from their adjacent terminals 2, 7.

In order to decrease the unwanted electrical coupling between the (3rd, 4th) and (3rd, 2nd) terminals, and (6th, 5th) and (6th, 7th) terminals, many approaches have been provided, such as creating an electrical coupling between 3rd and 1st terminals to balance the unwanted electrical coupling between the 3rd and 2nd, and creating electrical coupling between 6th and 8th terminals to balance the unwanted electrical coupling between the 6th and 7th terminals.

However, as mentioned above, since those eight terminals are arranged in a common plane, it is impossible to create those balancing electrical couplings, i.e. (1st, 3rd), (3rd, 5th), and (4th, 6th), (6th, 8th) terminals and it is unlikely to create any electrical channels therebetween to create those positive electrical couplings accordingly.

The Siemon Company, a US company, discloses a solution posted on the Internet. A hard copy thereof is herein attached for reference.

As clearly shown in FIG. 4 of that reference, the 6th and 2nd terminals are arranged in the first layer, the 8th, 5th, 4th, and 1st terminals are arranged in the second layer, and the 7th and 3rd terminals are arranged in the third layer.

The 6th terminal in the first layer has a rectangular loop having its longitudinal sides aligned with terminals 4th and 8th located in the second layer, while the 3rd terminal in the third layer also has a rectangular loop having its longitudinal sides aligned with 5th and 1st terminals located in the second layer.

In addition, the right longitudinal loop side of the 6th terminal further includes a square corresponding to a square formed on the 4th terminal. The left longitudinal loop side of the 3rd terminal also includes a square corresponding to a square formed on the 8th terminal.

All arrangements suggested by Siemon are to increase the couplings between (1st, 3rd), (3rd, 5th), and (4th, 6th), (6th, 8th) terminals thereby reducing electrical couplings of the 3rd and 6th terminals corresponding to their adjacent terminals (2nd, 4th) and (5th, 7th) respectively. By this arrangement, it is assumed that the noises imposed on terminals 3, 6 from respectively terminals 2, 7 can be adequately balanced by couplings between terminals 3, 1, and terminals 6, 8.

However, those three sets of terminals are arranged in three different layers, and an insulative material separates either of two adjacent sets of terminals. This will no doubt increase the complexity of the connector.

In addition, there are eight different shapes and configurations among those eight terminals. Each terminal has its own shape which is different from other, especially to the 3rd and 6th terminals, each including the rectangular loop portion which overlaps corresponding terminals to create wanted electrical couplings. Each loop further forms the square to increase the electrical couplings with corresponding terminals having the square. Even the electrical couplings can be created according to the requirement, those eight different configurations of the terminals will surely increase the difficulty and complexity in production.

On the other hand, it has not provided a grounding plane for grounding protections because the eight terminals are insert molded with the terminal material. When the terminals transmit signals, the crosstalk and the electromagnetic interfere (EMI) often happen. Since there is no grounding plane, the integrity of signals is not ensured.

Hence, an improved RJ modular connector is desired to overcome the disadvantages of the prior art connector.

SUMMARY OF THE INVENTION

It is an object of this invention to provide a RJ modular connector, and more particularly to a RJ modular connector having a substrate with conductive traces provided thereon to balance electrical couplings between terminals.

It is another object of this invention to provide a RJ modular connector, and more particularly to a RJ modular connector having a pair of grounding terminals to eliminate noise.

It is yet another object of this invention to provide a RJ modular connector which can be easily manufactured and assembled.

In order to achieve the objects set forth, a RJ modular connector in accordance with the present invention comprises a housing defining a plug receiving section and a terminal insert receiving section. A terminal insert is received in the terminal insert receiving section and includes a plurality of terminals and a pair of grounding terminals beside the plurality of terminals. A substrate provides conductive traces, a plurality of grounding traces, a grounding layer and a pair of ground pads thereon. The terminals are securely mounted onto the substrate. An electrical connection is established between one of the grounding terminals and the grounding traces for reducing the noise through the grounding layer and the ground pad.

Other objects, advantages and novel features of the invention will become more apparent from the following detailed description of the present embodiment when taken in conjunction with the accompanying drawings.

DETAILED DESCRIPTION OF PREFERRED EMBODIMENTS

Figure 1A:
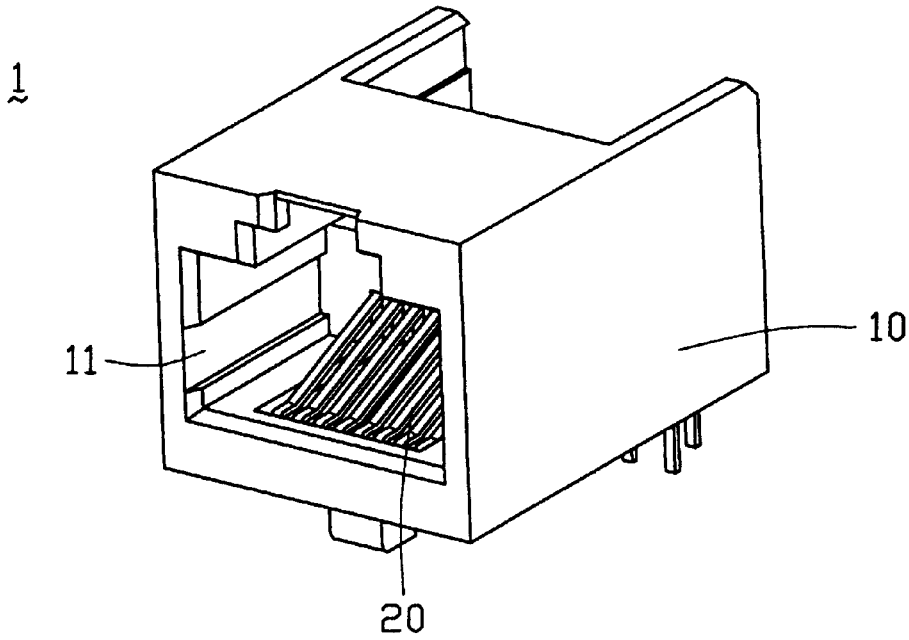
FIG. 1A is a perspective view of a RJ modular connector in accordance with the present invention.
Figure 1B:
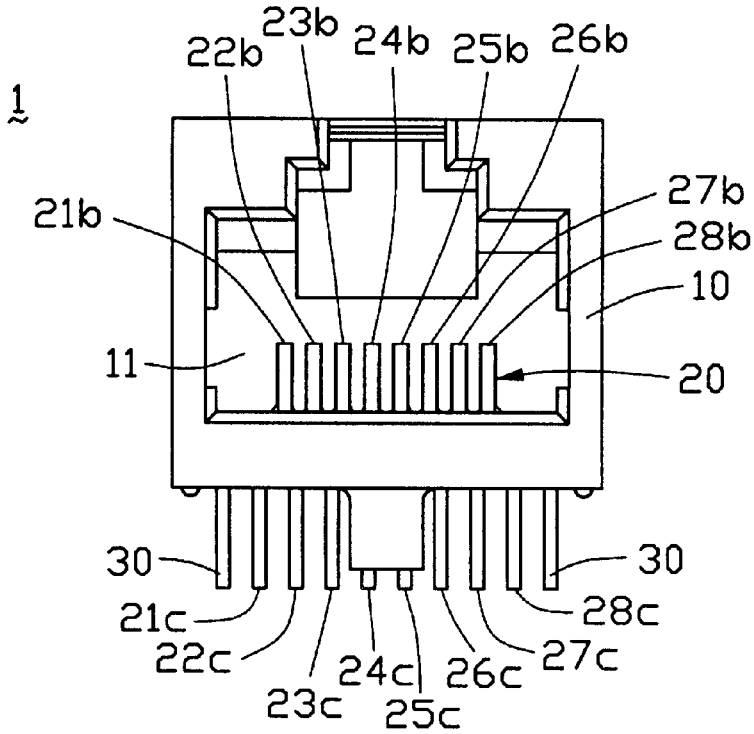
FIG. 1B is a front view of FIG. 1A.
Figure 1C:
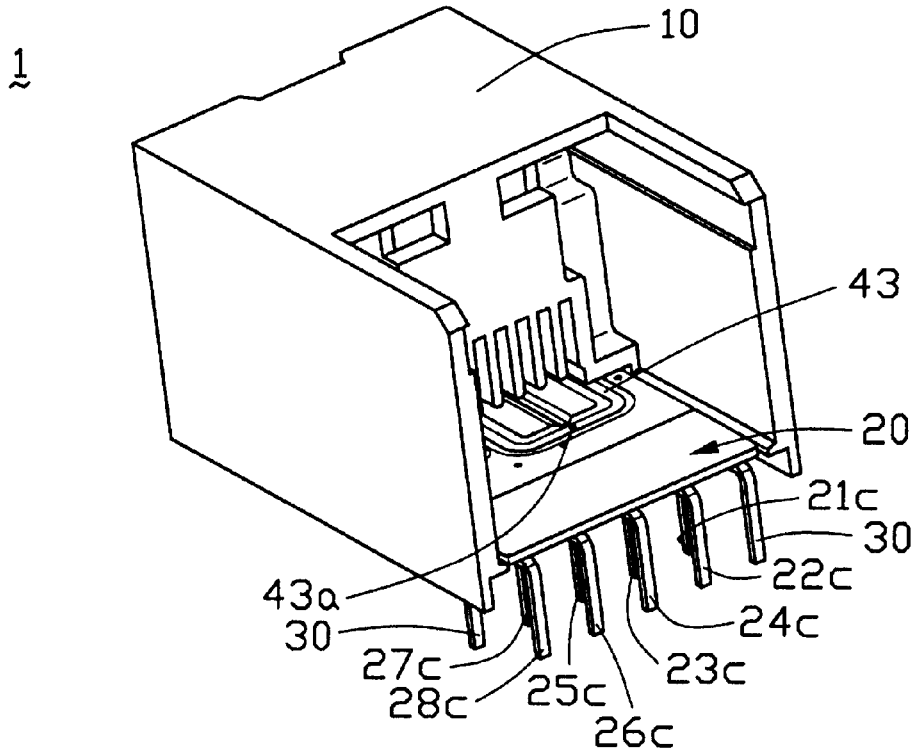
FIG. 1C is similar to FIG. 1A but viewed from a reverse direction.
Figure 1D:
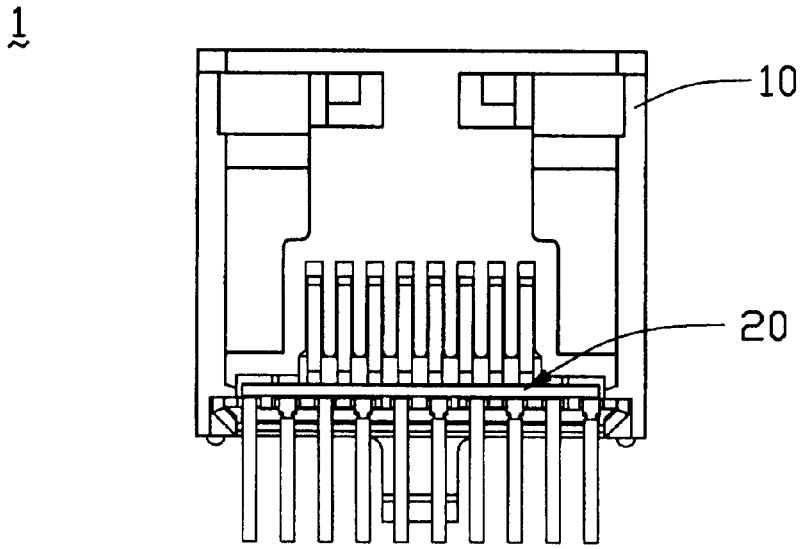
FIG. 1D is a front view of FIG. 1C.
Figure 1E:
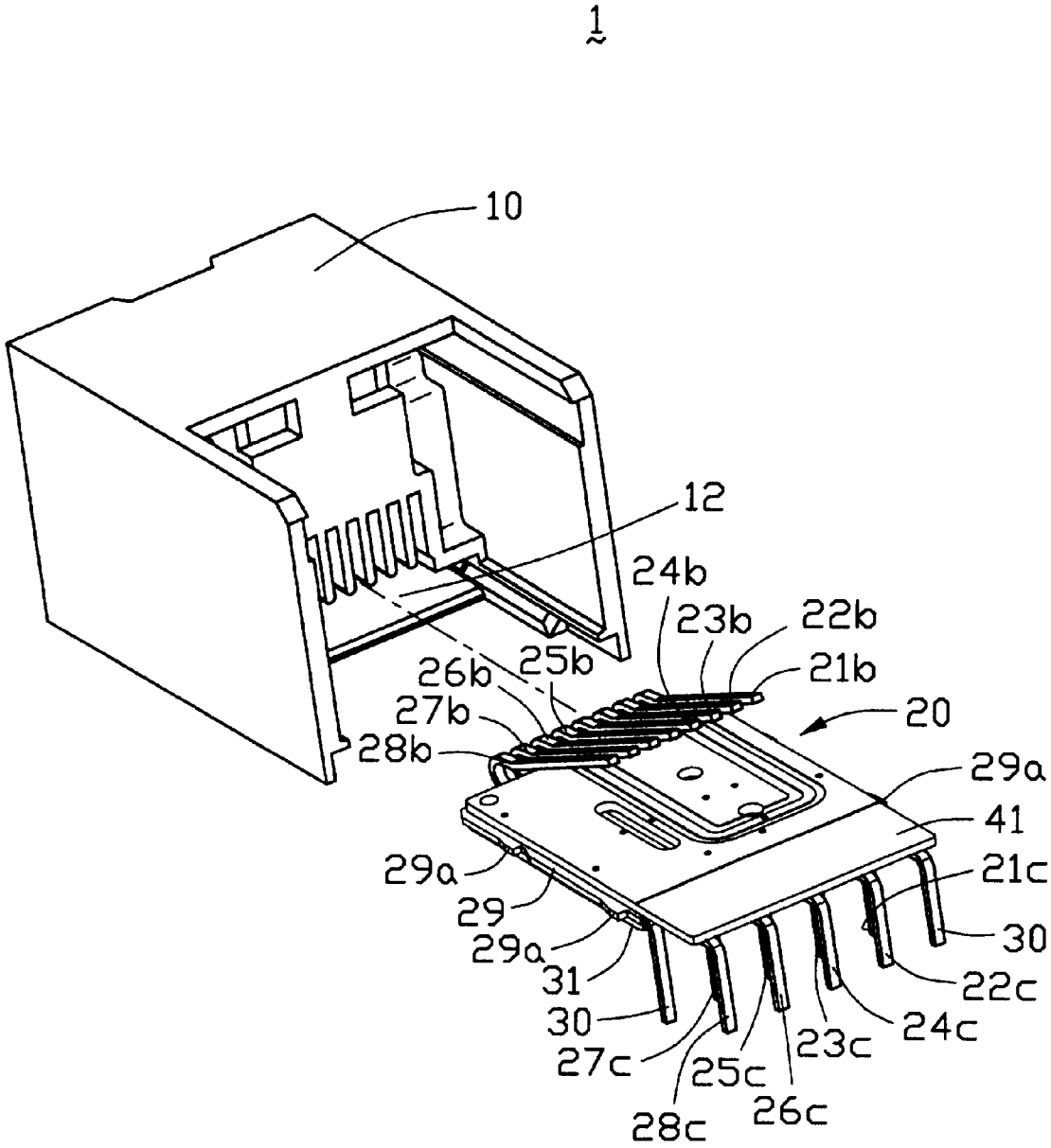
FIG. 1E is an exploded view of FIG. 1C.

Referring to FIGS. 1A to 1E, a RJ modular connector 1 in accordance with the present invention includes a housing 10 defining a plug receiving section 11, and a terminal insert receiving section 12 in which a modular terminal insert 20 securely attached therein and with contacting portions 21*b*, 22*b*, 23*b*, 24*b*, 25*b*, 26*b*, 27*b* and 28*b* extending into the plug receiving section 11, while leg portions 21*c*, 22*c*, 23*c*, 24*c*, 25*c*, 26*c*, 27*c*, 28*c* extending away from the housing 10 and a pair of grounding terminals 30 on opposite sides of the eight leg portions. The RJ modular connector 1 has a general dimension and shape corresponding to existing industry specifications. Accordingly, no details are given thereto. The unique feature of the present invention resides in providing the modular terminal insert 20 which can be easily manufactured and assembled in a cost-effective manner. In addition, the modular terminal insert 20 is arranged in such a manner that positive electrical couplings can be created between selected terminals to balance negative electrical couplings between selected terminals. By this arrangement, cross talk between certain terminals can be effectively eliminated or reduced.

Referring to FIGS. 2A to 2D in conjunction with FIGS. 3A to 3F, the terminal insert 20 in accordance with the present invention includes a plurality of terminals 21, 22, 23, 24, 25, 26, 27, and 28 sandwiched between lower and upper printed circuit boards 31 and 41. Among the terminals, terminals 21, 22 configure a first pair, terminals 23, 26 configure a second pair, terminals 24, 25 configure a third pair, and terminals 27, 28 configure a fourth pair.

Figure 2A:
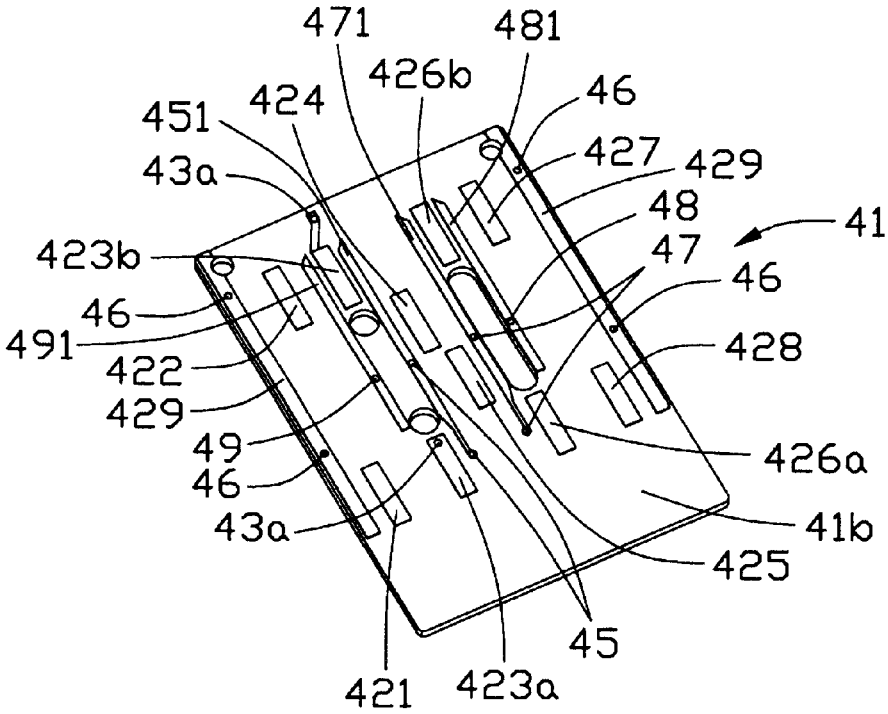
FIG. 2A is a bottom view of a top substrate.
Figure 2B:
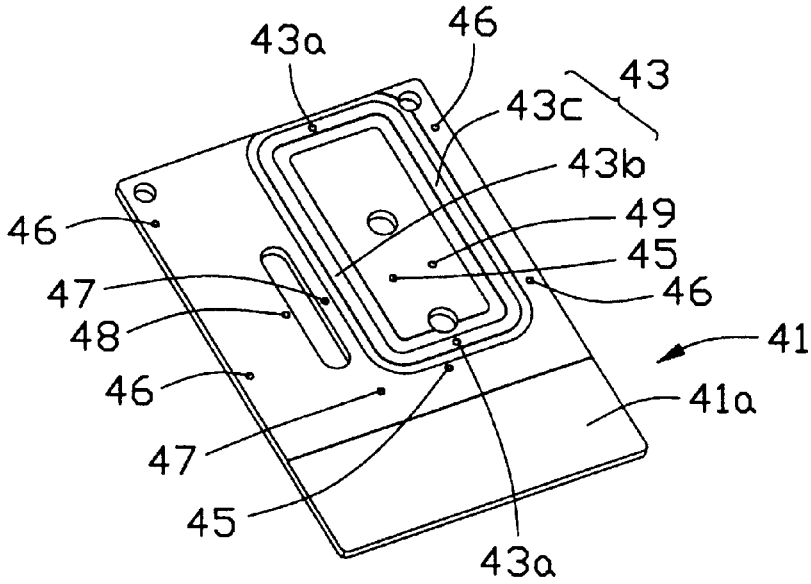
FIG. 2B is a top view of the top substrate shown in FIG. 2A.
Figure 2C:
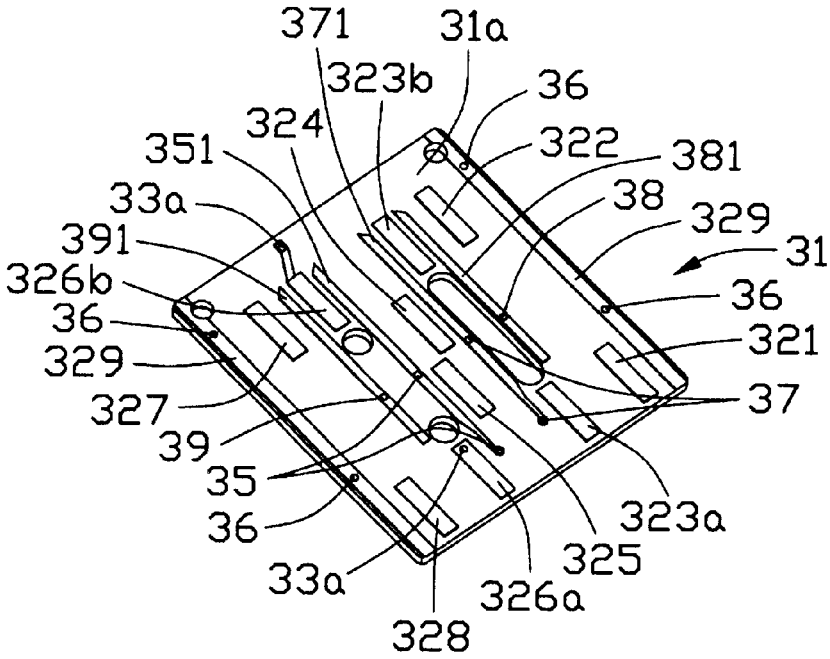
FIG. 2C is a top view of a bottom substrate.
Figure 2D:
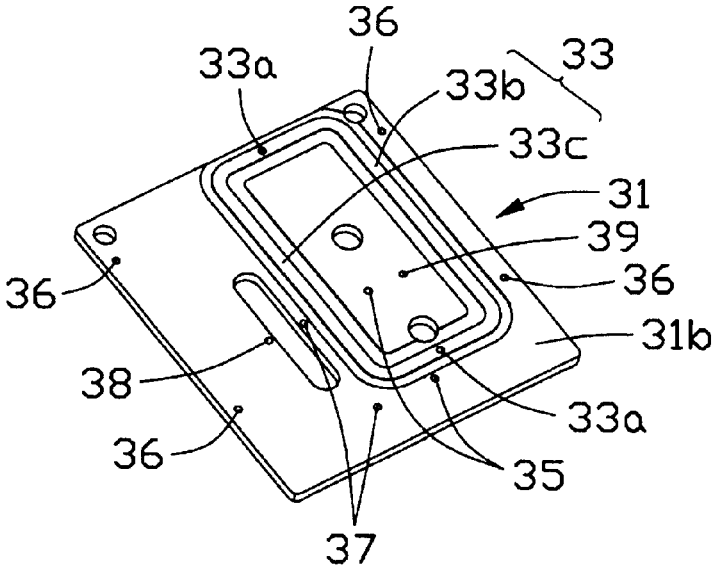
FIG. 2D is a bottom view of the bottom substrate shown in FIG. 2C.

Referring to FIGS. 2C and 2D, the lower printed circuit board 31 defines first and second faces 31*a*, 31*b* and with conductive footprints 321, 322, 323*a*, 323*b*, 324, 325, 326*a*, 326*b*, 327 and 328 and a pair of ground pads 329 formed on the first face 31*a*. The second face 31*b* is a grounding surface. A conductive trace 33 is rectangular and formed on the second face 31*b*. The conductive trace 33 is electrically connected to the conductive footprints 326 by means of vias 33*a*. Since the via 33*a* is formed by a through-hole coated with conductive material, such as solder, and is known to one of ordinary skill in the art, no details are given herein. In addition, the lower printed circuit board 31 also defines a plurality of vias 35, 36, 37, 38, 39. The vias 35, 37, 38, 39 have conductive materials therein and respectively connect with a narrow grounding trace 351, 371, 381, 391. These narrow grounding traces are respectively defined between the footprints of the lower printed circuit board 31 and can connect with the second face 31*b* through the vias 35, 37, 38, 39.

Referring to FIGS. 2A and 2B, the upper printed circuit board 41 defines first and second faces 41*a*, 41*b* and with conductive footprints 421, 422, 423*a*, 423*b*, 424, 425, 426*a*, 426*b*, 427 and 428 and a pair of ground pads 429 formed on the second face 41*b*. The first face 41*a* is a grounding surface. A conductive trace 43 is rectangular and formed on the first face 41*a*. The conductive trace 43 is electrically connected to the conductive footprints 423*a*, 423*b* by means of vias 43*a* which is identical to the vias 33*a*. In addition, the upper printed circuit board 41 also defines a plurality of vias 45, 46, 47, 48, 49 and a plurality of narrow grounding traces 451, 471, 481, 491 which are identical to those of the lower printed circuit board 31.

Among the footprints 321, 322, 323*a*, 323*b*, 324, 325, 326*a*, 326*b*, 327 and 328, the footprint corresponding to terminal 23 includes first and second portions 323*a*, 323*b*; while the footprint corresponding to terminal 26 also includes first and second portions 326*a*, 326*b*. Among the footprints 421, 422, 423*a*, 423*b*, 424, 425, 426*a*, 426*b*, 427 and 428, the footprint corresponding to the terminal 26 includes first and second portions 426*a*, 426*b*; while the footprint corresponding to the terminal 23 also includes first and second portions 423*a*, 423*b*.

As shown in FIGS. 3A–3D, the terminals 21, 22, 23, 24, 25, 26, 27 and 28 can be securely sandwiched between the printed circuit boards 31, 41 by applying solder pastes on the footprints 321, 322, 323*a*, 323*b*, 324, 325, 326*a*, 326*b*, 327, 328 and footprints 421, 422, 423*a*, 423*b*, 424, 425, 426*a*, 426*b*, 427, 428, and then reflowing the solder pastes such that the terminals 21, 22, 23, 24, 25, 26, 27 and 28 are completely and securely attached to the footprints 321, 322, 323*a*, 323*b*, 324, 325, 326*a*, 326*b*, 327, 328 of the lower printed circuit board 31 and footprints 421, 422, 423*a*, 423*b*, 424, 425, 426*a*, 426*b*, 427, 428 of the upper printed circuit board 41.

Figure 3A:
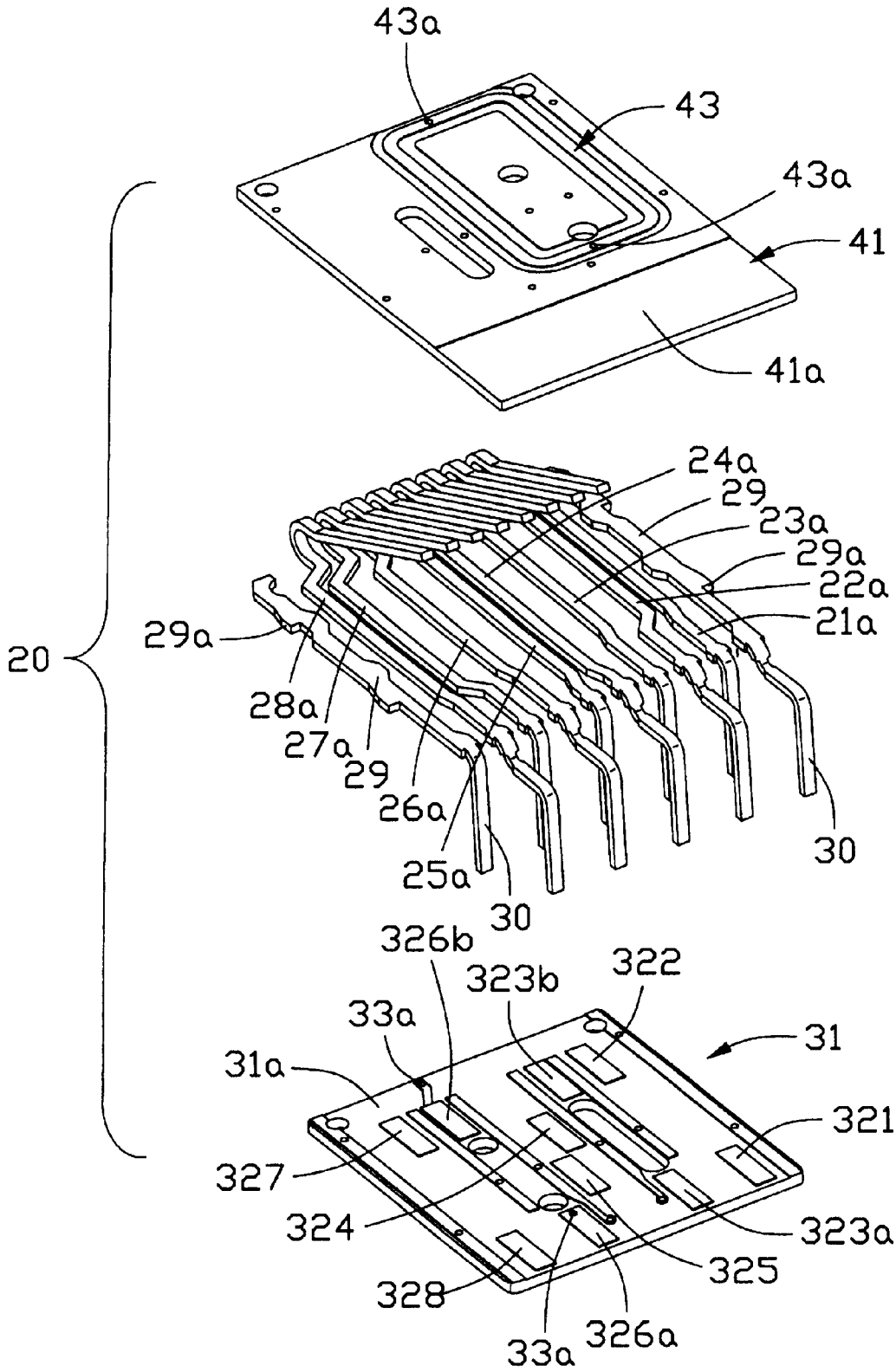
FIG. 3A is an exploded view of a terminal insert in accordance with the present invention.
Figure 3B:
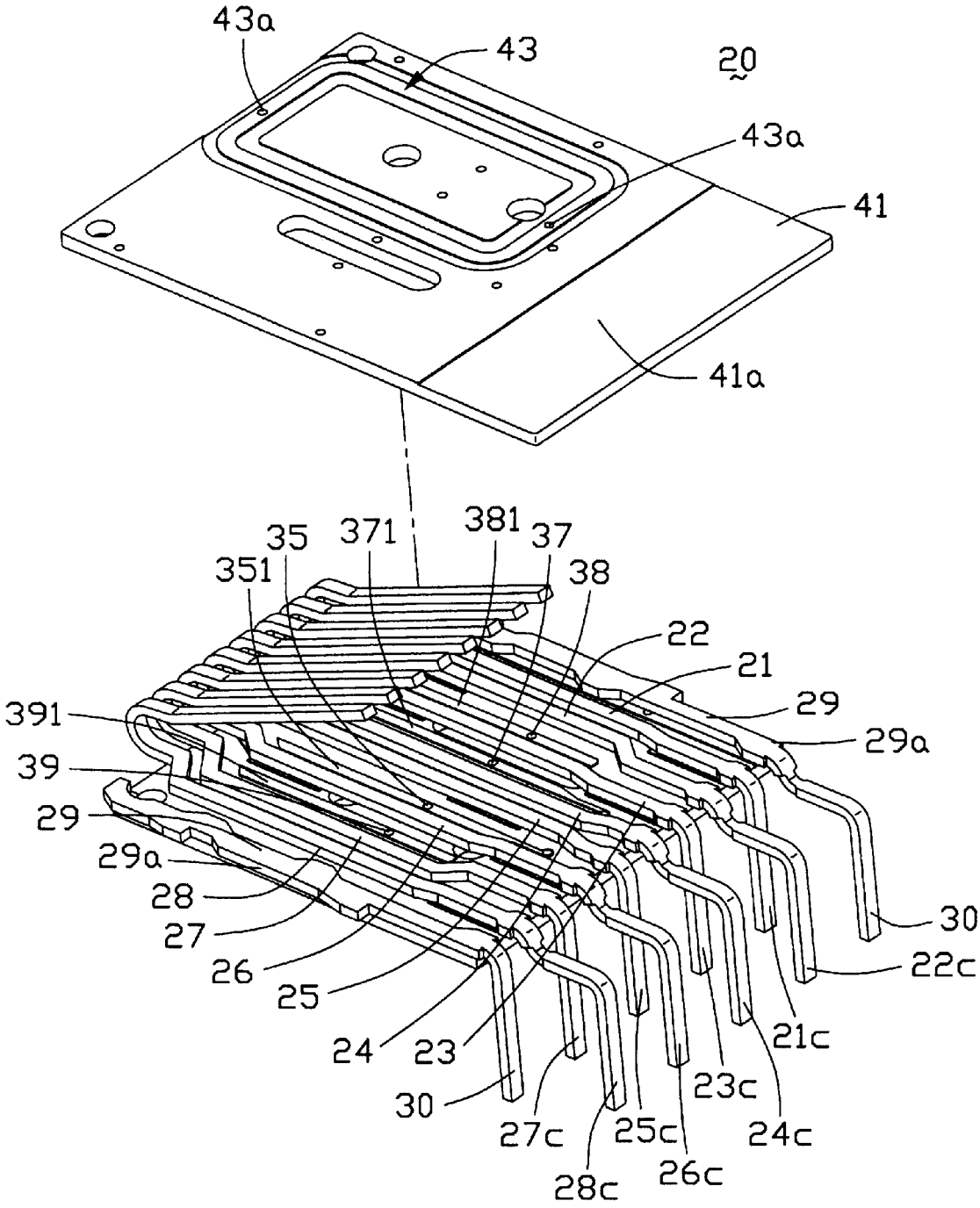
FIG. 3B is similar to FIG. 3A but with terminals attached to the bottom substrate.
Figure 3C:
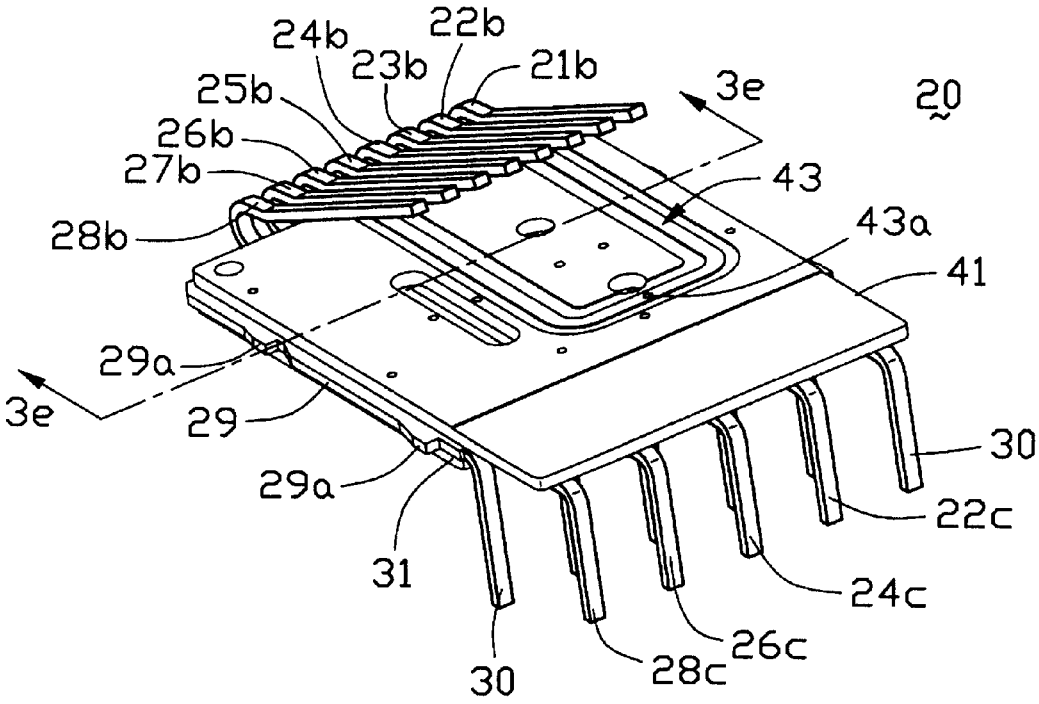
FIG. 3C is an assembled view of FIG. 3A.
Figure 3D:
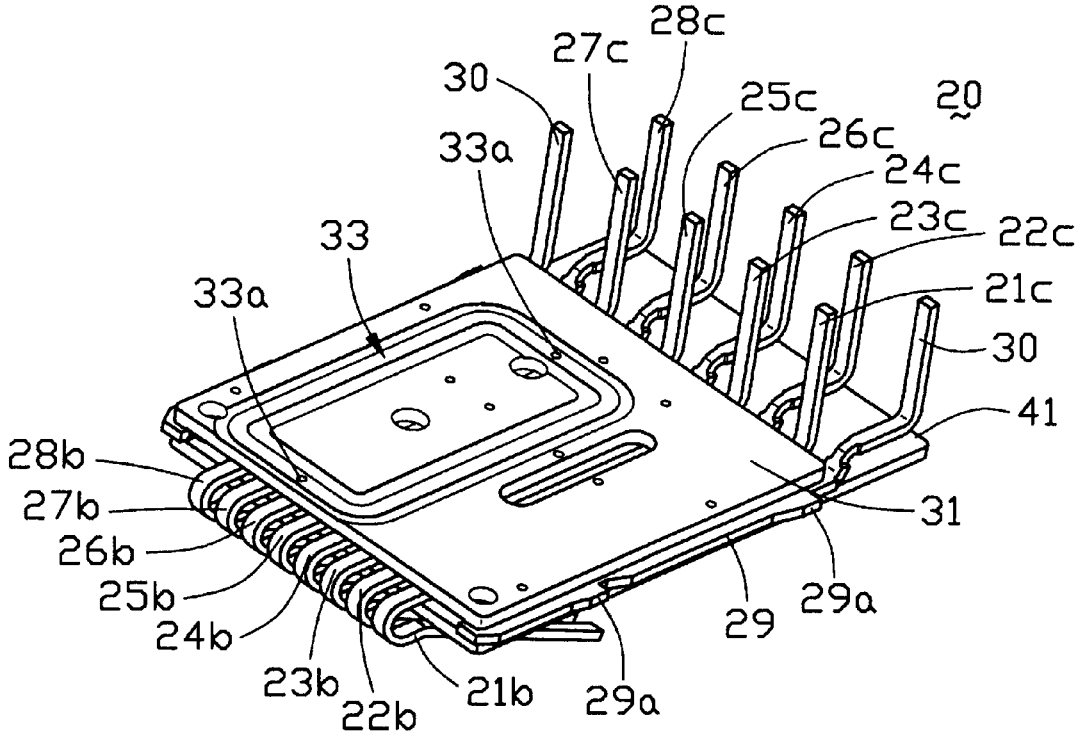
FIG. 3D is an assembled view of FIG. 3A but taken from a reverse direction of FIG. 3C.
Figure 3E:
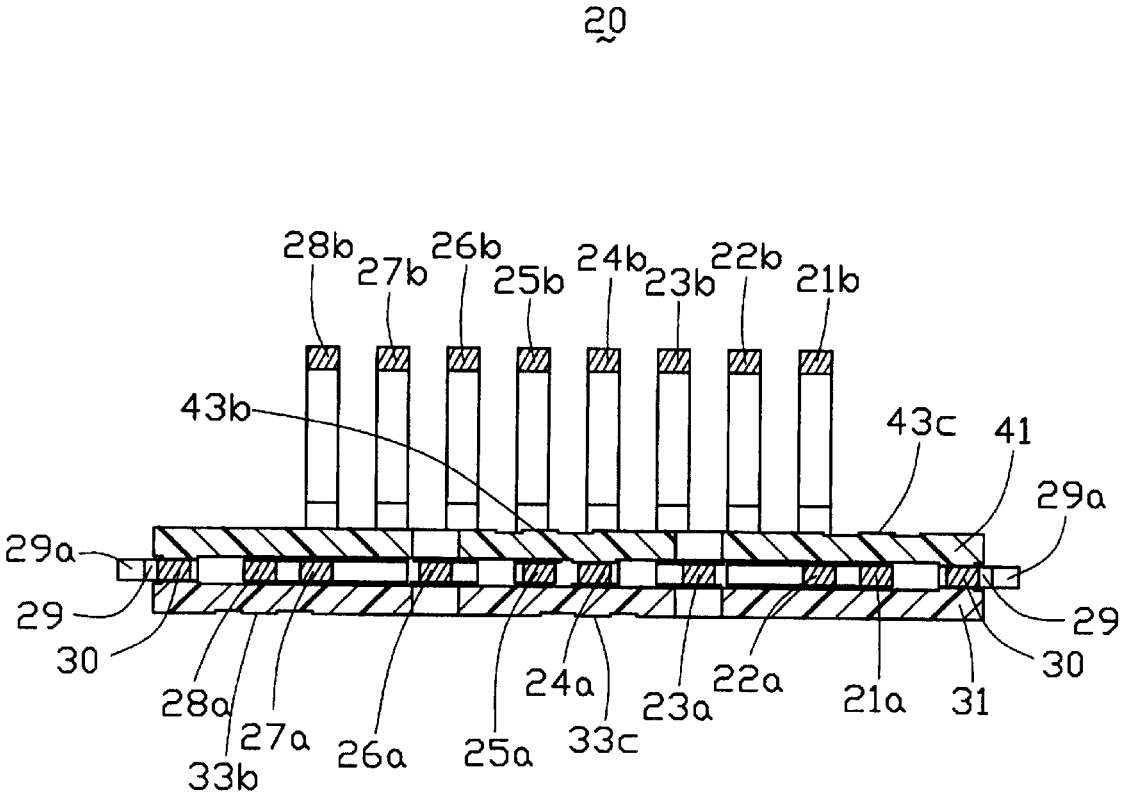
FIG. 3E is a cross sectional view taken along line 3*e*–3*e* of FIG. 3C.

As clearly shown in FIGS. 2B, 2D and 3E, the conductive trace 33 formed on the second face 31*b* of the lower printed circuit board 31 includes first and second portions 33*b* and 33*c* which are respectively aligned with terminals 28 and 24, while the conductive trace 43 formed on the first face 41*a* of the upper printed circuit board 41 includes first and second portions 43*b* and 43*c* which are respectively aligned with terminals 25 and 21. Accordingly, electrical couplings will be generated between the first portion 33*b* and the terminal 28, and the second portion 33*c* and the terminal 24. By the same reason, electrical couplings will be generated between the first portion 43*b* and the terminal 25, and the second portion 43*c* and the terminal 21.

As it can be readily appreciated that, the electrical coupling between the third terminal 23 and the first terminal 21 by means of the conductive trace 43 (via first portion 43*c*) will help to balance the electrical coupling between the third terminal 23 and the second terminal 22. While, the electrical coupling between the sixth terminal 26 and the eighth terminal 28 by means of the conductive trace 33 (via second portion 33*b*) will help to balance the electrical coupling between the sixth terminal 26 and the seventh terminal 27. As a result, the energy imposed on terminals 23, 26 by respectively terminals 22, 27 can be more balanced by the introduction of the electrical couplings between the terminals 23, 26 and terminals 21, 28, respectively.

Figure 3F:
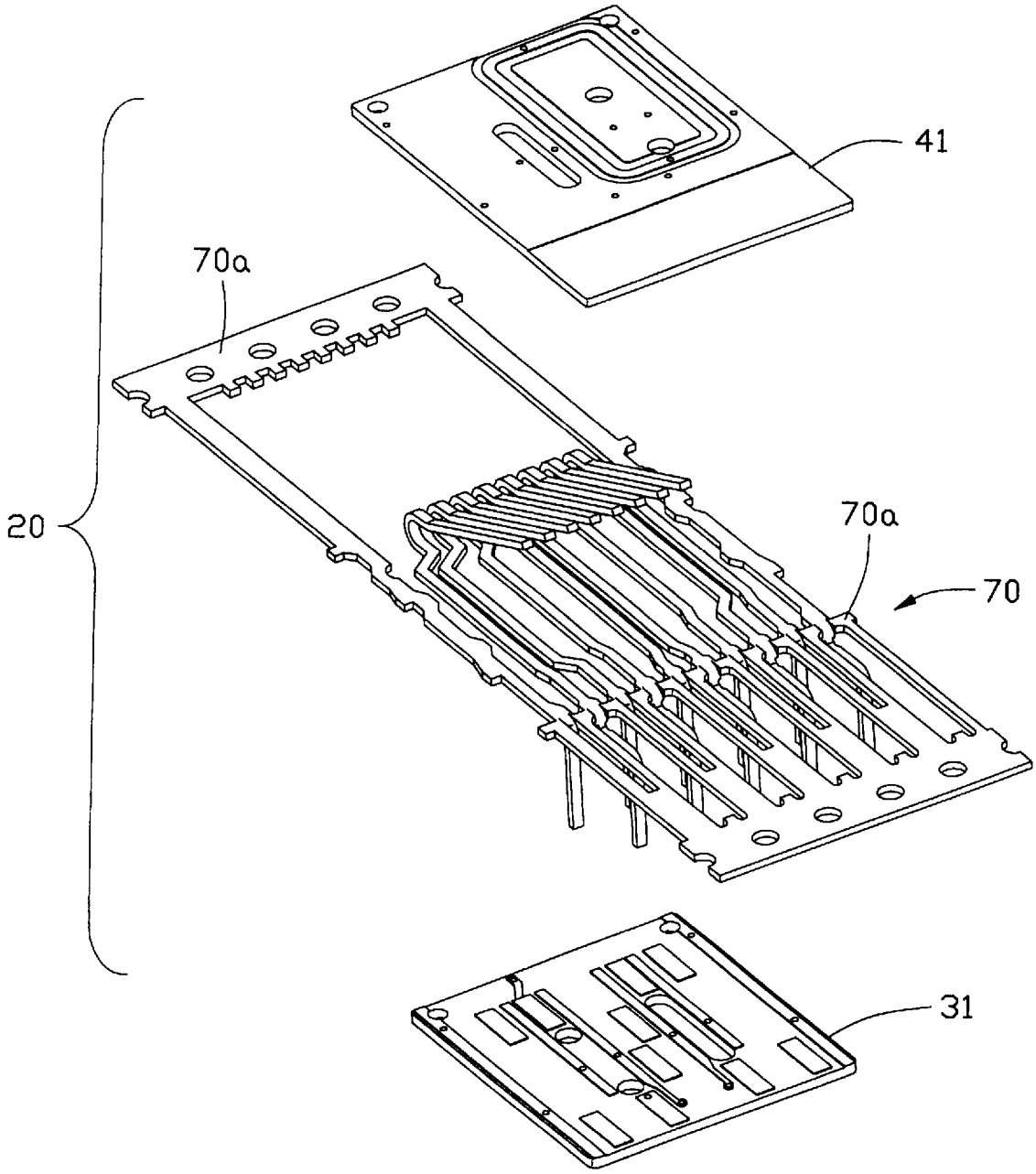
FIG. 3F is an exploded view of the terminal insert with a carrier attached thereto.

As it can be readily seen from FIG. 3F, the manufacturing of the terminal insert 20 is comparatively simple as compared to the prior art in which the terminals are integrally molded together. In the present invention, the terminals 21 to 28 can be simply stamped from a sheet metal 70. Then the terminals 21 to 28 can be easily sandwiched by the first and second printed circuit boards 31, 41. The carrier 70*a* can be simply trimmed off after the terminals 21 to 28 are securely attached and sandwiched between the first and second printed circuit boards 31 and 41.

In addition, it can be readily appreciated that, during the stamping process of the terminals 21 to 28, a pair of retaining beam 29 having barbs 29*a* can also be formed on the sheet metal 70. The retaining beams 29 can be securely sandwiched between the printed circuit boards 31, 41 by applying solder pastes on the ground pads 329 and 429, and then reflowing the solder pastes such that the retaining beams 29 are completely and securely attached to the ground pads 329 of the lower printed circuit board 31 and ground pads 429 of the upper printed circuit board 41. Accordingly, the terminal insert 20 resulted therefrom can be easily inserted into the terminal insert receiving section 12 and securely retained therein by the barbs 29*a*. A pair of grounding terminals 30 is respectively connected with the retaining beams 29 (referring to FIGS. 3A to 3D) for being connected to the grounding traces of a motherboard on which the RJ modular connector 1 is mounted. When the noise among the terminals happens, the narrow grounding traces 351, 371, 381, 391, 451, 471, 481, 491 respectively defined between the footprints can ground the noise to the grounding layer 31*b*, 41*a* through the vias 35, 37, 38, 39, 45, 47, 48, 49. Then, the grounding layer grounds the noise to the ground pads 329, 429 through the vias 36, 46. Finally, the noise is grounded to the grounding traces of the motherboard via the grounding terminals 30. In light of this, all terminals are more or less covered by ground path such that the noise and cross talks can be reduced. Furthermore, using the retaining beams 29 connected with the grounding terminals 30 to attach the printed circuit board 31 and 41 to the housing 10 can increase the bonding between the upper and lower boards 31, 41.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A RJ modular connector comprising:

a housing defining a plug receiving section and a terminal insert receiving section; and a terminal insert received in said terminal insert receiving section and comprising a first printed circuit board (PCB), a plurality of signal terminals mounted to the PCB and between a pair of grounding terminals;

wherein the PCB defines a conductive signal trace formed on a first side thereof and a plurality of grounding traces on a second side thereof, each grounding trace being defined between a selected pair of said signal terminals, a grounding layer and a pair of ground pads being disposed on the PCB for establishing an electrical connection between the grounding terminal and the grounding traces for reducing the noise between the selected pairs of signal terminals; and wherein the pair of grounding pads being disposed at an outer most side edge of the PCB to surround the grounding traces, the signal traces and the signal terminals; and wherein the RJ modular connector further comprising a second PCB having a second conductive signal trace and a plurality of second grounding traces on opposite sides thereof; and wherein the plurality of signal terminals and the two grounding terminals are sandwiched between the first and second printed circuit boards; and wherein said ground pads respectively define a pair of vias for electrically connecting with the grounding layer; and wherein each of said PCB defines a plurality of vias corresponding to each grounding trace to electrically connecting the grounding layers and the grounding traces; and wherein said conductive trace is rectangular and at least one via is formed on one of the shorter sides of the conductive trace; and wherein each of the grounding terminals comprises a retaining beam attached on the ground pads; and wherein the retaining beam defines a plurality of barbs to secure the terminal insert into the housing.

* * * * *